US005133093A

United States Patent [19]

Tsuchiya

[11] Patent Number: 5,133,093

[45] Date of Patent: Jul. 28, 1992

[54] BRIEF

[75] Inventor: Makoto Tsuchiya, Tokyo, Japan

[73] Assignee: Chacott Kabushiki Kaisha, Tokyo, Japan

[21] Appl. No.: 549,858

[22] Filed: Jul. 9, 1990

[30] Foreign Application Priority Data

Mar. 27, 1990 [JP] Japan ..... 2-30471[U]

[51] Int. Cl.[5] ..... A41B 9/02

[52] U.S. Cl. ..... 2/403; 2/2; 2/400

[58] Field of Search ..... 2/403, 2, 400, 401, 2/402

[56] References Cited

U.S. PATENT DOCUMENTS

| | | | |
|---|---|---|---|
| 3,176,686 | 4/1965 | Barnes | 2/2 |
| 3,229,692 | 1/1966 | Creed | 2/2 |
| 3,314,422 | 4/1967 | Phillips | 2/403 |
| 3,517,666 | 6/1970 | Atlee | 2/403 |
| 3,787,892 | 1/1974 | Quinn | 2/2 |
| 3,788,314 | 1/1974 | Noreen | 2/2 |
| 3,909,847 | 10/1975 | Holt | 2/2 |
| 4,014,044 | 3/1977 | Figueroa | 2/2 |
| 4,471,772 | 9/1984 | Miller | 2/403 |
| 4,922,899 | 5/1990 | Graff | 2/2 |

FOREIGN PATENT DOCUMENTS

| | | | |
|---|---|---|---|
| 1406069 | 6/1965 | France | 2/403 |
| 2226125 | 11/1974 | France | 2/400 |
| 2608203 | 6/1988 | France | 2/400 |
| 637344 | 5/1950 | United Kingdom | 2/2 |
| 1604558 | 12/1981 | United Kingdom | 2/403 |

*Primary Examiner*—Werner H. Schroeder
*Assistant Examiner*—Diana L. Biefeld
*Attorney, Agent, or Firm*—Jordan and Hamburg

[57] ABSTRACT

A brief in which there is provided a shaping portion in a front portion of the brief for shaping the formation of a swell at the front of the brief at the position corresponding to the male genitalia. The shaping portion has a concave inner surface and a convex outer surface and is composed of a three-layer construction including an outer cloth, an inner cloth, and a soft synthetic resin layer. There is provided a concave portion for receiving the male genitalia at the inner surface of the shaping portion and the outer surface of the shaping portion is formed with a convex formation, and there is provided a fixing portion at the open ends of the concave portion. The shaping portion has a hard synthetic resin layer inside the shaping portion, and a receiving bag is mounted inside the resin layer to insert a shaping member into the receiving bag.

13 Claims, 4 Drawing Sheets

BRIEF

DESCRIPTION OF FIELD OF THE ART AND RELATED TECHNIQUE

The present invention relates to a brief for improving the silhouette of the lower half of a male body when a man wears the brief.

The applicant of the present application has proposed a brief, (as in Japanese Utility Model Publication Laid-Open No.heisei 1-129203), in which a shaping member is inserted thereinto at the position corresponding to the part of a man's genitalia thereby adjusting the swell in that area and obtaining a beautiful silhouette of the lower half of the body of the man who wears a dancing suit or a swimming suit.

According to such conventional example, it is possible to produce a beautiful silhouette, however it is not possible for the shaping member to follow extreme movement of the male wearing the brief.

OBJECT AND SUMMARY OF THE INVENTION

The object of the invention is to present a brief capable of smoothly following such movement without deforming the silhouette and thereby obtaining a beautiful silhouette.

The other object of the present invention is to stably support the male genitalia of a person who wears the brief without deforming the silhouette.

The other object of the present invention is to stably support the male genitalia of a person who wears the brief while enabling following the extreme movement of the person wearing the brief.

A further object of the present invention is to fit the male genitalia of a person who wears the brief to the brief while taking into account the size of the male genitalia of a person who wears the brief, thereby enabling smooth following of the movements and eliminating any deformation of the silhouette.

The first feature of the present invention resides in that there is provided a shaping portion having a concave inner surface and a convex outer surface for forming a swell in the front portion of the brief, such shaping portion having a three-layer construction including an outer cloth, an inner cloth, and a soft synthetic resin layer provided between the outer cloth and the inner cloth.

The second feature of the present invention resides in that there is provided a shaping portion in the front of the brief, a hard synthetic resin layer within the shaping portion having a concave portion for receiving the male genitalia at the inner surface thereof, and a convex portion is provided at the outer surface thereof. A fixing portion is provided at the open end of the concave portion.

The third feature of the present invention resides in that there is provided a shaping portion having a concave inner surface and a convex outer surface at the front of the brief, a thin and hard synthetic resin layer, and a receiving bag for receiving a shaping member at the inner side of the layer.

The fourth feature of the present invention resides in that the shaping member is composed of a shaping member made of a hard synthetic resin, the shaping member having a concave portion at the whole surface thereof and a fixing portion at the open end of the concave portion.

The shaping member may also include cotton, cloth or the like except for the shaping member mentioned in the previously described fourth feature.

According to the present invention, the front portion is integrally formed or a three-layer construction composed of an outer cloth, an inner cloth, and a soft synthetic resin layer, such that it is therefore possible to smoothly follow body movements without any deformation of the silhoutte, which results in a beautiful silhouette. Furthermore, according to the present invention, the shaping portion has a hard synthetic resin layer at the concave portion thereof, and fixing portions at the both sides of the open end, and therefore the male genitalia of a person who wears the brief may be stably supported thereby enabling following of extreme body movements.

Furthermore, according to the present invention there is provided a receiving bag inside the hard synthetic resin layer of the shaping portion for receiving the shaping member, and therefore it is possible to select a suitable shaping member, thereby obtaining a suitable fitness and good following of body movements without any deformation of the silhouette.

The features of the present invention will be more clearly understood from the descriptions on the basis of the drawings.

DESCRIPTION OF THE PREFERRED EMBODIMENTS

Figure 1:
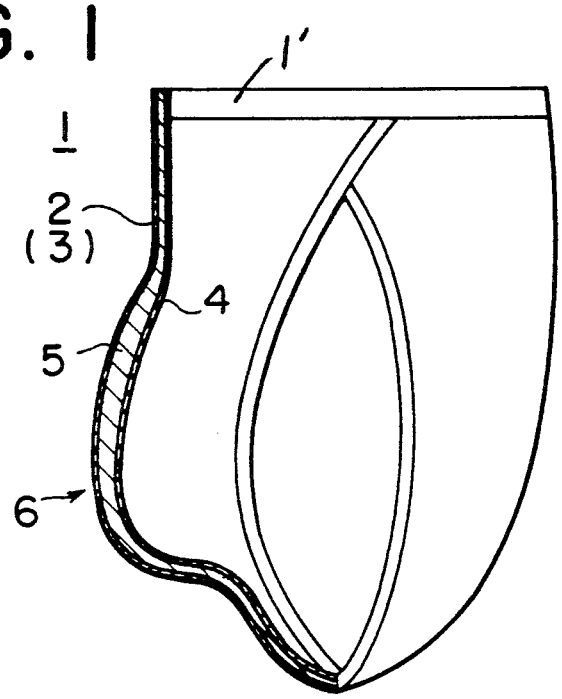
FIG. 1 is a partial section and side view of one embodiment of the present invention.
Figure 2:
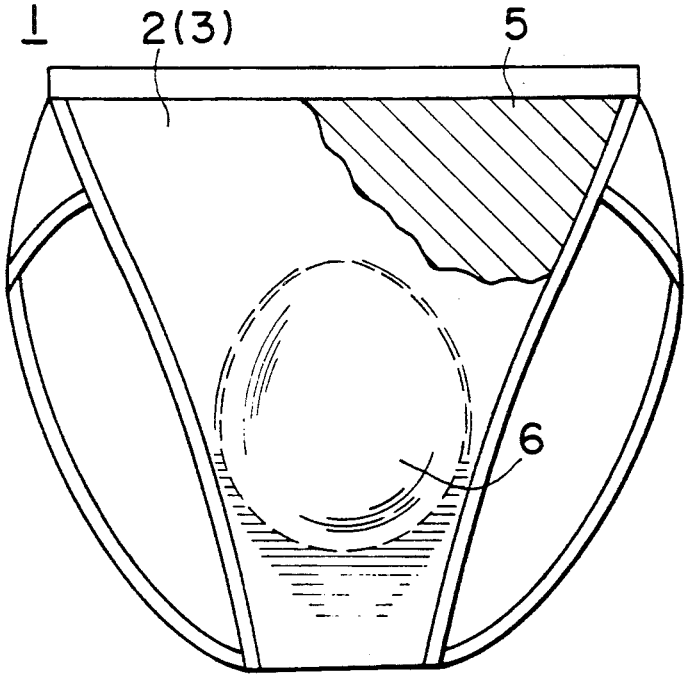
FIG. 2 is a front view, partially broken away, of the same.

As shown in FIGS. 1 and 2, the front portion 2 of a brief 1 is composed of a three-layer construction including an outer cloth 3, an inner cloth 4, and a soft polyurethane layer 5 located between the outer and inner cloths. There is provided a shaping portion 6 forwardly swelled at the position of the front portion 2 corresponding to the position of the male genitalia. The shaping portion 6 is for the purpose of improving the shape of the swell portion generated at the front portion of the brief. The shaping portion 6 is formed so as to include the male genitalia and improve the silhouette and it is made in an approximately L-letter like formation in section as shown in the drawings.

The front portion 2 is made such that a soft polyurethane layer 5 is sandwiched between the outer cloth 3 and the inner cloth 4 and are integrally pressed together with heat. The shaping portion 6 is also made simultaneously. A waist band is shown at 1'.

Figure 3:
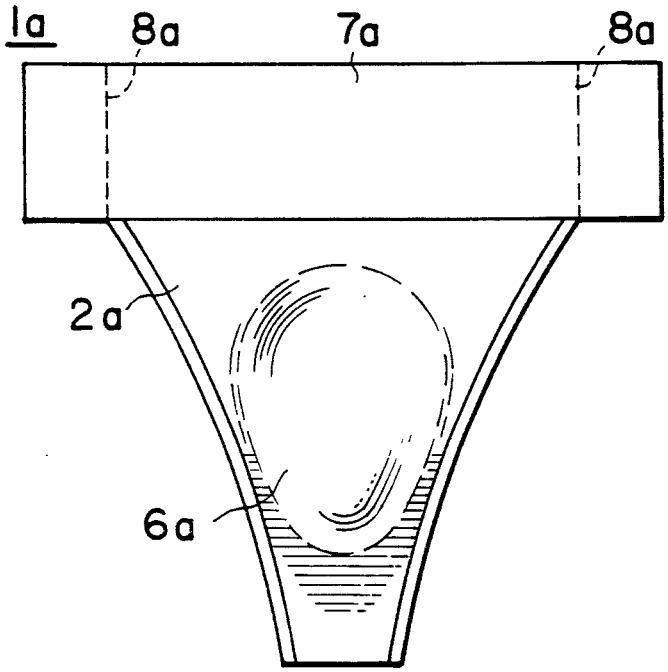
FIG. 3 is a front view showing other embodiment.

The present invention is not limited to the above-mentioned example, but is applicable to the supporter type brief as shown in FIG. 3. In this example, there are provided, in the waist band portion 7*a*, supports or stays 8*a* and 8*a* made of plastic material or a thin metallic wire dispposed in the width direction (vertical direction) at the position corresponding to the upper ends of the front portion 2a. By this, the flexible waist band portion is prevented from being bent in the width direction after prolonged use. Numeral 6a indicates a shaping portion.

Figure 4:
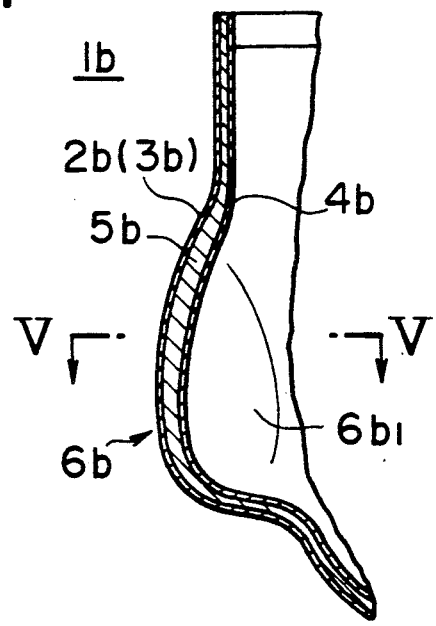
FIG. 4 is a section and side view showing a main portion of another embodiment.
Figure 5:
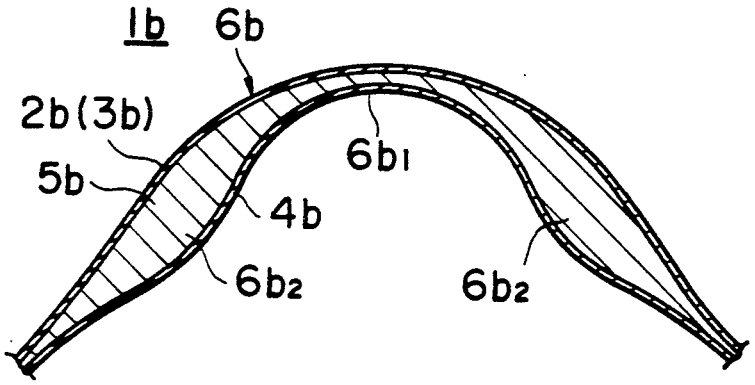
FIG. 5 is an enlarged sectional view taken along the line V—V in FIG. 4.

The brief 1b as shown in FIGS. 4 and 5 is made for the purpose of following extreme movements of the person who wears the brief. In this example, there is inserted a hard synthetic resin layer 5b into the shaping portion 6b of the front portion 2b, the resin layer 5b being made of rigid type foamed polyurethane and covered by an outer cloth 3b and an inner cloth 4b. The shaping portion 6b is provided with a concave portion 6b1 for receiving the male genitalia and fixing portions 6b2 and 6b2 are disposed at both sides of the open end of the concave portions. The fixing portion 6b2 function to limit the movement of the male genitalia due to a extreme movement of the person who wears the brief, when the male genitalia is located within the concave portion 6b1.

The front portion 2b is made such that the hard synthetic resin layer 5b sandwiched by the outer cloth 3b and the inner cloth 4b is integrally pressed.

In this example, since the male genitalia is stably received in the concave portion 6b1, it is possible to follow extreme body movements.

In the brief 1b as shown in FIGS. 4 and 5, the shaping portion 6b is provided by the rigid type foamed polyurethane layer 5b and the inner surface formation of the concave portion 6b1 and is fixed. Therefore a gap between the male genitalia and the inner surface of the concave portion may be sometimes produced in accordance with the size of the male genitalia.

Figure 6:
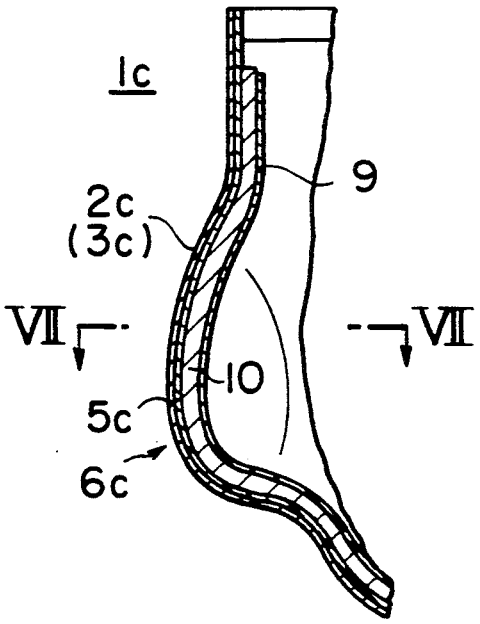
FIG. 6 is a section and side view showing a main portion of a further embodiment.
Figure 7:
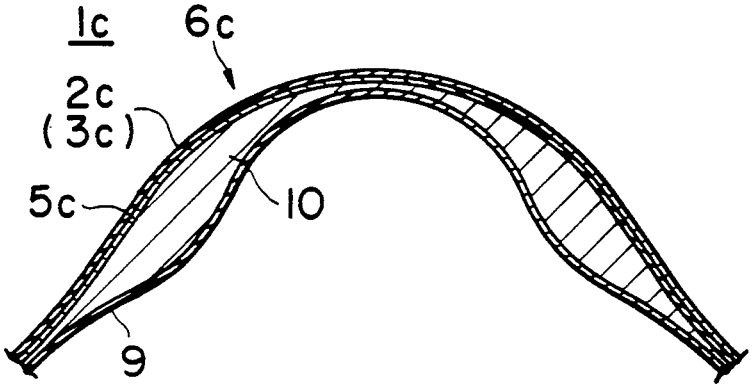
FIG. 7 is an enlarged sectional view taken along the line VII—VII in FIG. 6.

Under the circumstance, the brief 1c shown in FIGS. 6 and 7 is formed to eliminate such a gap.

Figure 8:
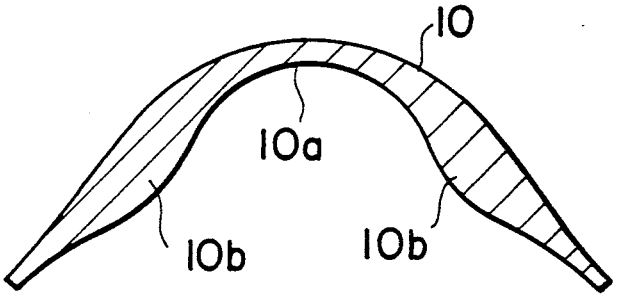
FIG. 8 is a sectional view of a shaping member.

In the brief 1c, the front portion 2c includes a rigid type polyurethane layer 5c with a thin thickness inside an outer cloth 3c. There is provided a receiving bag 9 inside the shaping portion 6c. Into the receiving bag 9, a shaping member 10 made of rigid type foamed polyurethane as shown in FIG. 8 is inserted. The shaping member 10 is removable from the receiving bag 9.

The shaping member 10 is substantially the same as that of the shaping portion 6b as shown in FIG. 5, and 10a is a concave portion and 10b is a fixing portion.

In usage of the brief 1c, the user can select a shaping member 10 suitable for the user out of various sizes of shaping members and inserts it into the receiving bag 9.

The shaping member is not limited to such shaping member 10, but it may be cotton or cloth.

The present invention is especially usefull for a brief to improve the silhouette of the case of lower half of the body, such as in the tights worn by a male dancer a gymnastics player, and an aerobatics participant but it is not limited to such examples and it is usable also for a swimming suit, townwear such as denim pants, and trunks.

In the case of using the brief with a swimming suit, the material of the brief may be suitable so as not to absorb water.

What is claimed is:

1. A male brief comprising a waist band, a front section extending downwardly from said waist band, a rear section extending downwardly from said waist band, said brief having a bottom at which said front and rear sections are joined, leg openings between said front and rear sections, said front section having an upper portion joined to said waist band, a lower portion joined to said bottom, and an intermediate portion between said upper and lower portions, said intermediate portion having a forward extending shaped part which projects forwardly of said upper and lower portions and which is disposed about the male genitalia when the brief is being worn, said shaped part being curved with an outer side which is convex and an inner side which is concave, said shaped part being of a three layer construction including inner and outer cloth layers and a foamed synthetic layer disposed between said inner and outer cloth layers, said intermediate portion having side parts extending to either side of said shaped part, said side parts being of the same three layer construction as said shaped part and forming continuations of said shaped part in that each side part has inner and outer cloths and a foamed synthetic layer which are continuations of the inner and outer cloths and said foamed synthetic layer, respectively of said shaped part, each of said side parts having a variable thickness.

2. A male brief according to claim 1, wherein said foamed synthetic layer is a soft-non-rigid layer.

3. A male brief according to claim 1, wherein said foamed synthetic layer is a rigid layer.

4. A male brief according to claim 1, wherein the maximum thickness of said side parts is greater than the maximum thickness of said shaped part.

5. A male brief comprising a waist band, a front section extending downwardly from said waist band, a rear section extending downwardly from said waist band, said brief having a bottom at which said front and rear sections are joined, leg openings between said front and rear sections, said front section having an upper portion joined to said waist band, a lower portion joined to said bottom, and an intermediate portion between said upper and lower portions, said intermediate portion having a forward extending shaped part which projects forwardly of said upper and lower portions and which is disposed about the male genitalia when the brief is being worn, said shaped part being curved with an outer side which is convex and an inner-side which is concave, said shaped part being of a three layer construction including inner and outer cloth layers and a foamed synthetic layer disposed between said inner and outer cloth layers, said intermediate portion having side parts extending to either side of said shaped part, said side parts being of the same three layer construction as said shaped part and forming continuations of said shaped part in that each side part has inner and outer cloths and a foamed synthetic layer which are continuations of the inner and outer cloths and said foamed synthetic layer, respectively of said shaped part, the inside surface of each of said side parts having a convex configuration.

6. A male brief according to claim 5, wherein said foamed synthetic layer in said shaped part and in said side parts is a rigid foamed synthetic layer.

7. A male brief according to claim 5, wherein said inner and outer cloths and said foamed synthetic layer are integrally joined.

8. A male brief comprising a waist band, a front section extending downwardly from said waist band, a rear section extending downwardly from said waist band, said brief having a bottom at which said front and rear sections are joined, leg openings between said front and rear sections, said front section having an upper portion joined to said waist band, a lower portion joined to said bottom, and an intermediate portion between said upper and lower portions, said intermediate portion having a forward extending shaped part which projects forwardly of said upper and lower portions and which is disposed about the male genitalia when the brief is being worn, said shaped part being curved with an outer side which is convex and an inner side which is concave, said shaped part having an inner cloth and an outer cloth, said outer cloth having an inner surface, said shaped part also having a rigid synthetic layer on said inner surface of said outer cloth disposed so as to define a receiving pocket between said rigid synthetic layer and said inner cloth, said shaped part further including a rigid shaping member removably disposed in said shaping pocket such that different size shaping members can be replaceably inserted into said shaping pocket.

9. A male brief according to claim 8, wherein said rigid synthetic member is made of a rigid foamed synthetic resin.

10. A male brief according to claim 8, wherein said rigid shaping member has a central section having an outer convex surface and an inner concave surface, said rigid shaping member having said extensions extending to either side of said central section.

11. A male brief according to claim 10, wherein said side extensions have a variable thickness.

12. A male brief according to claim 11, wherein the maximum thickness of said side extensions is greater than the maximum thickness of said central section.

13. A male brief according to claim 8, wherein said rigid synthetic layer has an inner concave surface and said rigid shaping member has an outer convex surface, said inner concave surface of said rigid synthetic layer being of the same configuration as the outer convex surface of said rigid shaping member, said inner concave surface of said rigid synthetic layer being in abutting contact with said outer convex surface of said rigid shaping member.

* * * * *